US012371252B2

(12) United States Patent
Brennan, Jr.

(10) Patent No.: US 12,371,252 B2
(45) Date of Patent: Jul. 29, 2025

(54) INTERMODAL WAREHOUSING SYSTEM

(71) Applicant: Sea Box, Inc., Cinnaminson, NJ (US)

(72) Inventor: James F. Brennan, Jr., Moorestown, NJ (US)

(73) Assignee: Sea Box, Inc., Cinnaminson, NJ (US)

( * ) Notice: Subject to any disclaimer, the term of this patent is extended or adjusted under 35 U.S.C. 154(b) by 77 days.

(21) Appl. No.: 17/638,926

(22) PCT Filed: Sep. 10, 2020

(86) PCT No.: PCT/US2020/050071
§ 371 (c)(1),
(2) Date: Feb. 28, 2022

(87) PCT Pub. No.: WO2021/050644
PCT Pub. Date: Aug. 18, 2021

(65) Prior Publication Data

US 2022/0324611 A1 Oct. 13, 2022

Related U.S. Application Data

(60) Provisional application No. 62/898,313, filed on Sep. 10, 2019.

(51) Int. Cl.
*B65D 90/00* (2006.01)

(52) U.S. Cl.
CPC ..... *B65D 90/0026* (2013.01); *B65D 2519/00233* (2013.01)

(58) Field of Classification Search
CPC ..... B65D 19/385; B65D 2519/00233; B65D 2519/00671; B65D 90/0013; B65D 90/0026
See application file for complete search history.

(56) References Cited

U.S. PATENT DOCUMENTS 3,456,829 A * 7/1969 Glassmeyer ..... B65D 90/0026 220/4.01
3,850,295 A * 11/1974 Black ..... B65D 85/06 108/53.5

(Continued)

FOREIGN PATENT DOCUMENTS

CN 109625642 A 4/2019
EP 2955123 A2 12/2015

OTHER PUBLICATIONS

Extended European Search Report issued in European Application No. 20863424.6 dated Sep. 18, 2023.

*Primary Examiner* — Matthew W Ing
(74) *Attorney, Agent, or Firm* — Emmett S. Collazo; Jonathan M. Waldman

(57) ABSTRACT

The intermodal warehousing system includes a platform, a plurality of legs, four corner castings, and additional castings located on the long sides of the platform. Each of the legs may be extendable with an anchor located at one end and a casting located at the other, the leg and the casting being comprised of aluminum. The anchor is carried by a steel plate that is bolted to the leg. To avoid a galvanic reaction, aluminum bushings with steel inserts are welded to the interior of the leg and steel bolts secure the steel plate to the steel inserts. An external handle includes a bolt extending into leg and cooperating with a wedge located therein that moves the anchor up or down. The handle bolt, wedge and anchor are so constructed and arranged so that rotation of the handle moves the anchor up or down to lock the leg to a casting.

8 Claims, 5 Drawing Sheets

(56) References Cited

U.S. PATENT DOCUMENTS

| | | | | |
|---|---|---|---|---|
| 2003/0094124 | A1* | 5/2003 | Wishart | B65D 19/38<br>108/51.11 |
| 2007/0210686 | A1* | 9/2007 | Adducci | A47B 81/00<br>312/265.2 |
| 2016/0101893 | A1* | 4/2016 | Moore | B65D 90/18<br>108/53.5 |

* cited by examiner

INTERMODAL WAREHOUSING SYSTEM

TECHNICAL FIELD

The present invention is directed toward an intermodal warehousing system that utilizes International Standardization Organization (ISO) shipping pallets or platforms. The invention includes improvements to the corner posts and to the platforms themselves. The purpose of the invention is to make it easier and faster to add or remove the posts and to increase the load capability of a stacked system.

BACKGROUND ART

International Standardization Organization (ISO) shipping pallets or platforms have been used for many years for transporting bulk items or materials. Frequently, they are used to ship goods within an ISO shipping container. See, for example, U.S. Pat. No. 9,663,268 which describes a typical platform and the manner in which it is used. The entire content of that document is incorporated herein by reference. As is also well known in the art, the ISO shipping containers are made of steel and are either 40 feet long or 20 feet long and are generally 8 feet wide and either 8.5 feet or 9.5 feet tall.

In some cases, the platform is loaded with equipment or material that extends substantially the entire height of the container. There are times, however, when the material on the platform extends only a relatively short height because of limitations as to how high the material can be stacked. In such cases, it becomes inefficient to ship, store or warehouse such partially loaded platforms as there would be wasted space above the material.

As shown in the above mentioned U.S. Pat. No. 9,663,268 and in U.S. Published Application No. 2008/0210687, the ISO platforms include corner castings so that they can be secured to the ISO containers. Corner casting are, per se, well known in the art as described, for example, in U.S. Pat. Nos. 3,722,714; 3,752,511; 6,729,098 and 9,120,618, the entire contents of all of the foregoing applications and publications are incorporated herein by reference.

When a platform is not or cannot be loaded to a full height, it has been proposed to stack two or more high so as to avoid wasted space in a container or in a storage or warehouse facility. This has been accomplished by using corner posts at each corner of the platform that are adapted to support a second platform above the first. These corner posts are preferably 4 feet in height so that two platforms with 3 or 4 feet of material carried thereon can fit into a standard ISO container. See, for example, FIG. 3 of U.S. Pat. No. 9,663,268. See, also, FIG. 9 of U.S. Published Application No. 2008/0210687.

As shown most clearly in FIG. 3A of U.S. Pat. No. 9,663,268, each corner post includes a conventional tongue or anchor at the bottom thereof and a conventional casting at the top. The tongue, of course, allows the post to connect to a lower platform while the casting permits another upper platform to be carried atop thereof. These connections are made in a conventional manner well known to those skilled in the art.

While these prior art corner posts have met with some success, they have many drawbacks. Because they have been made almost entirely from steel, they are very heavy, making it difficult for one man to carry and put into place. In addition, tools are required to assemble the posts to the platform. And, installation is labor intensive and time consuming. Even further, with conventional posts, there are left and right posts which must be properly positioned in its proper corner. This requires additional inventory of posts and adds to the installation time. It has also been noted that the second or upper platform of a stacked platform can sag under the weight of the material carried thereon. This does not occur with the bottom platform as it is supported on the ground or floor or other surface.

There is, therefore, a need for a system that includes posts that are lighter so as to be able to be carried by one man and which are substantially less labor intensive to install. There is also a need for such a system that can more easily support a second (and possibly subsequent) platform above a lowermost one.

SUMMARY OF THE INVENTION

The present invention is designed to overcome the deficiencies of the prior art discussed above. It is an object of the present invention to provide an intermodal warehousing system that allows platforms to be stacked but are stronger than existing systems.

It is another object of the present invention to provide such an intermodal warehousing system that includes legs that are substantially lighter than conventional legs.

It is a still further object of the present invention to provide such an intermodal warehousing system that is more easily and quickly assembled or disassembled.

In accordance with the illustrative embodiments demonstrating features and advantages of the present invention, there is provided an intermodal warehousing system that includes a platform and a plurality of legs. In addition to the normal four corner castings, there are additional castings located on the long sides of the platform to help support another platform that is mounted above the lower platform.

Each of the legs includes an elongated square portion which may be extendable with an anchor located at one end and a casting located at the other, the elongated square portion and the casting being comprised of aluminum. The anchor is carried by a steel plate that is bolted to the square portion. To avoid a galvanic reaction, aluminum bushings with steel inserts are welded to the interior of the leg and steel bolts secure the steel plate to the steel inserts. An external handle includes a bolt extending into said leg and cooperating with a wedge located therein that moves the anchor up or down. The handle bolt, wedge and anchor are so constructed and arranged so that approximately a 180 degree rotation of the handle moves the anchor up or down approximately one quarter of an inch which is all that is needed to lock the leg to a casting.

Other objects, features, and advantages of the invention will be readily apparent from the following detailed description of the preferred embodiment thereof taken in conjunction with the drawings.

DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
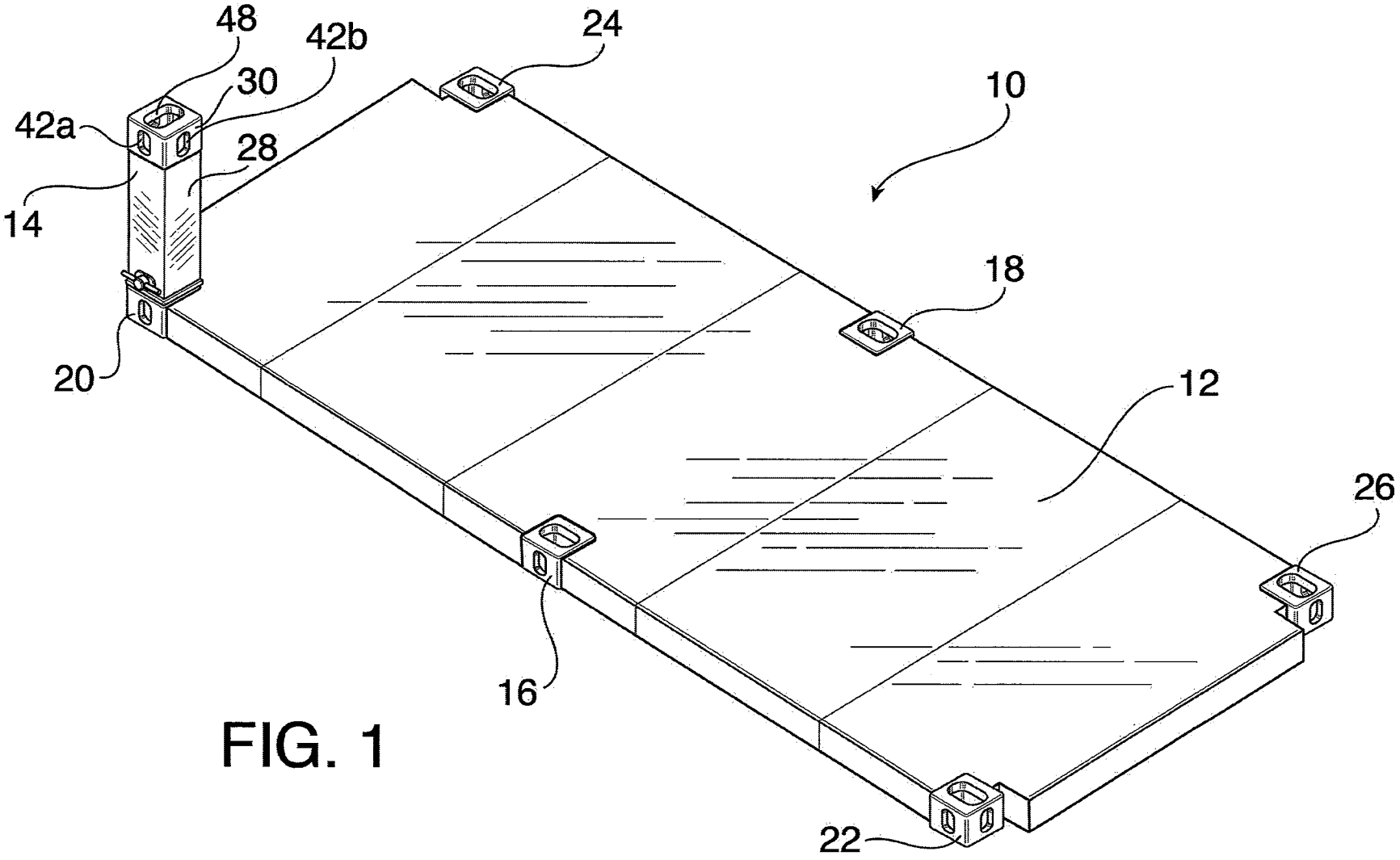
FIG. 1 is a front top perspective view of a warehousing system of my invention including an International Standardization Organization (ISO) shipping pallet or platform and a corner post or leg.
Figure 2:
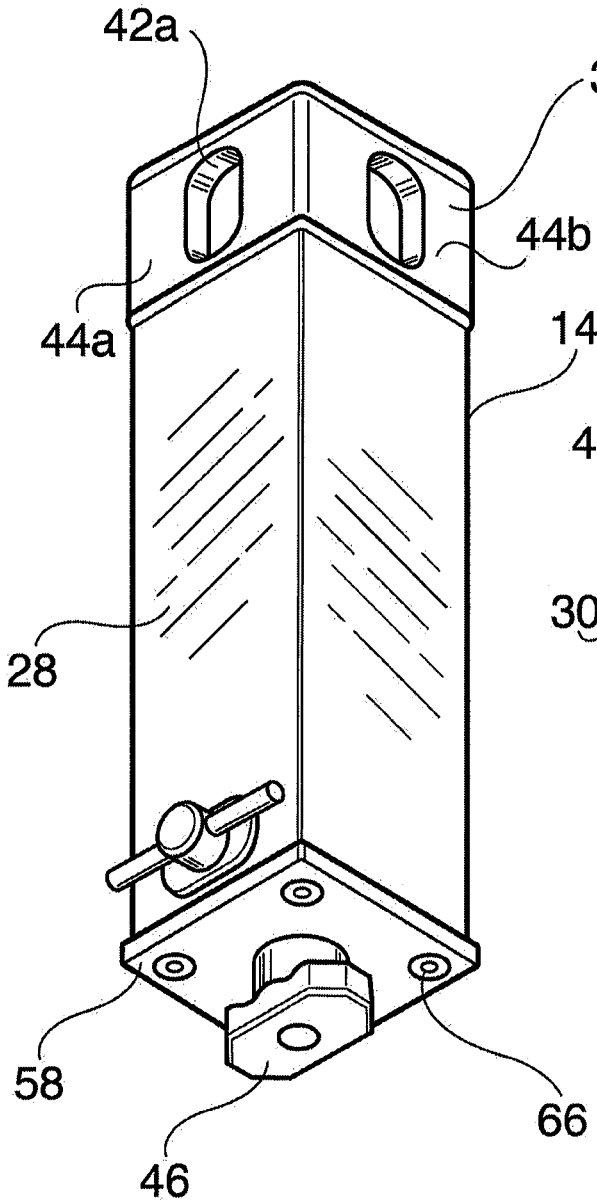
FIG. 2 is a front and bottom perspective view of an improved leg.

Referring now to the drawings in detail wherein like reference numerals have been used throughout the various figures to designate like elements, there is shown in FIG. 1 an intermodal warehousing system constructed in accordance with the principles of the present invention and designated generally as 10. The system 10 includes International Standardization Organization (ISO) rectangularly shaped shipping pallet or platform 12 of and corner posts or legs 14, only one of which is shown for clarity.

The platform 12 is of relatively conventional construction and does not require substantial discussion. However, it does differ from conventional platforms in that it includes two additional castings 16 and 18 on either long side of the platform 12 in addition to the castings 20, 22, 24 and 26 that are located at the corners thereof. The additional castings 16 and 18 are located substantially equidistant between the ends of the platform 12. These additional castings 16 and 18 allow for the use of intermediate posts or legs in addition to the normal corner posts 14. Substantial weight can, therefore, be carried by another platform (not shown) mounted above the shown platform 12 without it sagging as the intermediate posts provide additional center support.

The posts or legs, such as leg 14 also differ from conventional legs described above. Conventional legs are made of steel which makes them extremely heavy to the point that they cannot be easily handled by a workman. The legs of the present invention are comprised of aluminum which makes them substantially lighter than conventional legs. This includes both the elongated square tube portion 28 and the corner casting 30. All of the legs are identical to each other. Accordingly, while only one leg is being show described in detail, it will be understood that the description applies to all of the legs which are constructed in the identical manner.

Figure 4A:
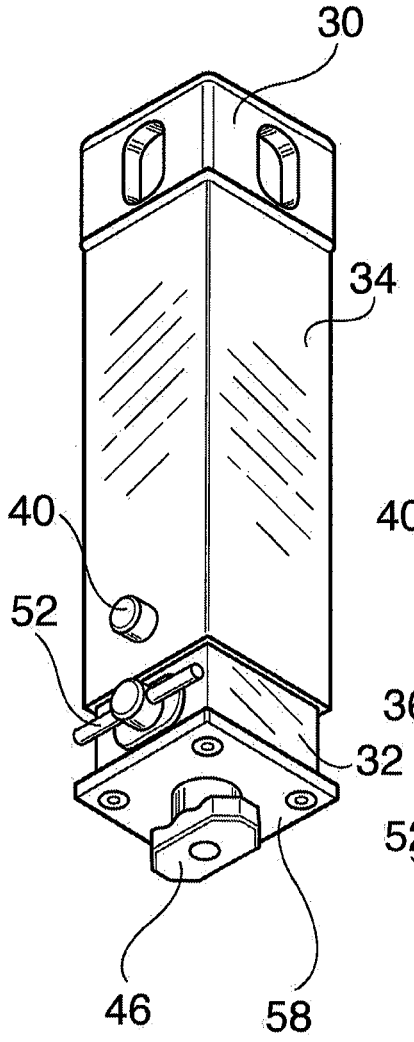
FIGS. 4*a*, 4*b* and 4*c* show a telescoping form of the leg.
Figure 4B:
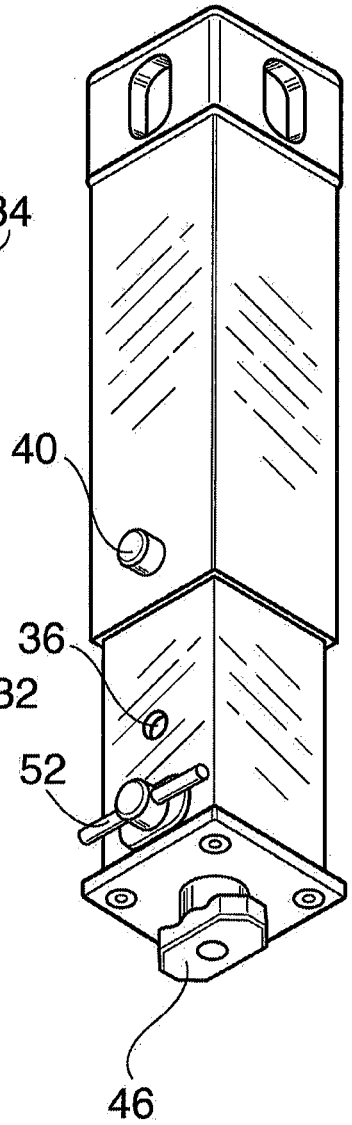
Figure 4C:
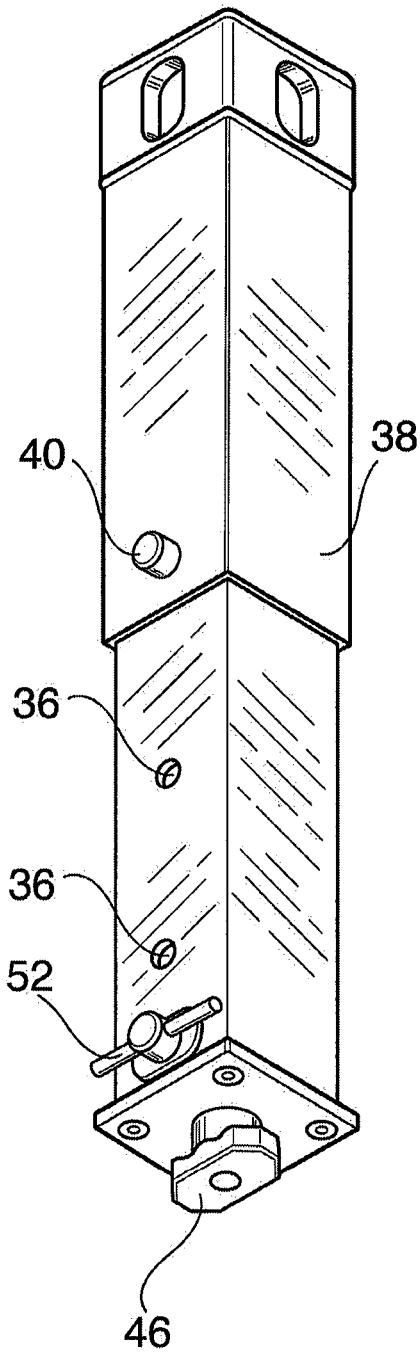
Figure 5:
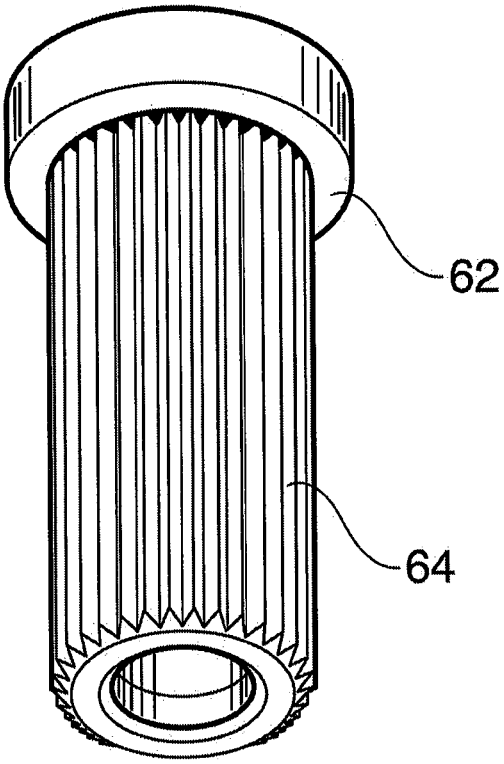
FIG. 5 is a perspective view of a zinc plated steel bushing used with the invention.
Figure 6:
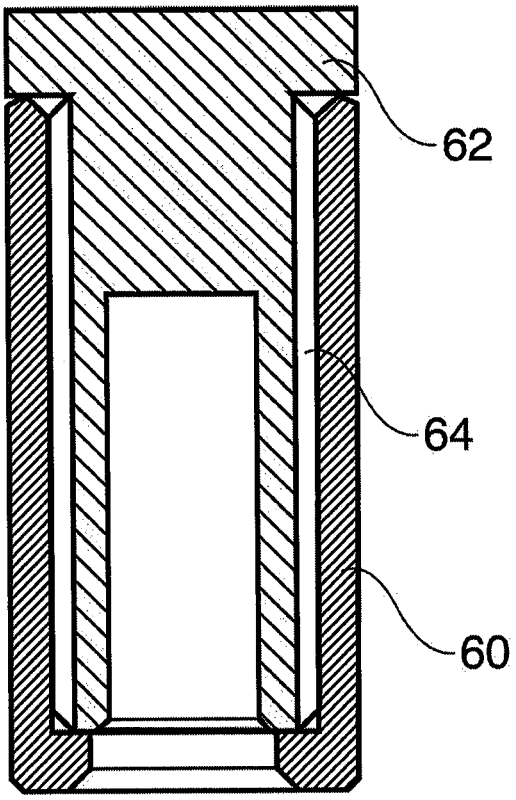
FIG. 6 is a cross-sectional view of the steel bushing swaged into an aluminum bushing.
Figure 7:
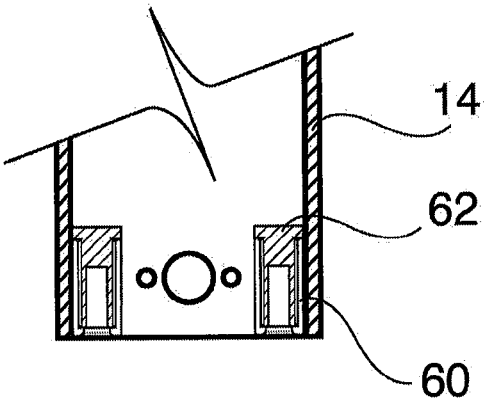
FIG. 7 is a cross-sectional view showing the combined bushings welded into a leg.
Figure 8:
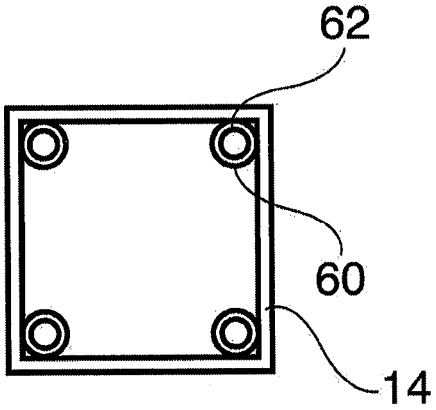
FIG. 8 is a bottom view of FIG. 7.
Figure 10B:
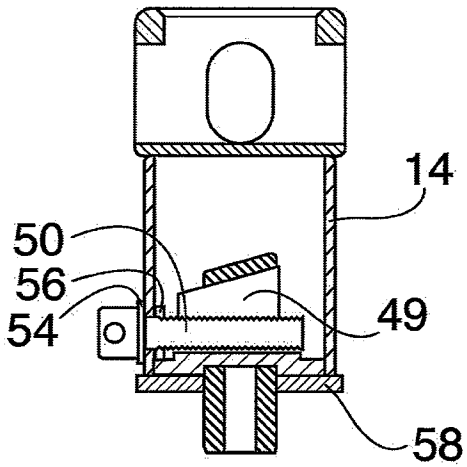
FIGS. 10*a* and 10*b* are similar to FIGS. 9*a* and 9*b* but illustrating the locking tongue in its engaged state.
Figure 10A:
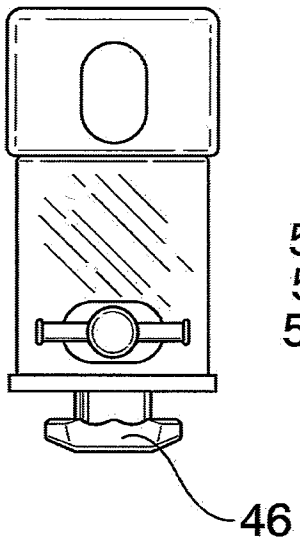
Figure 9B:
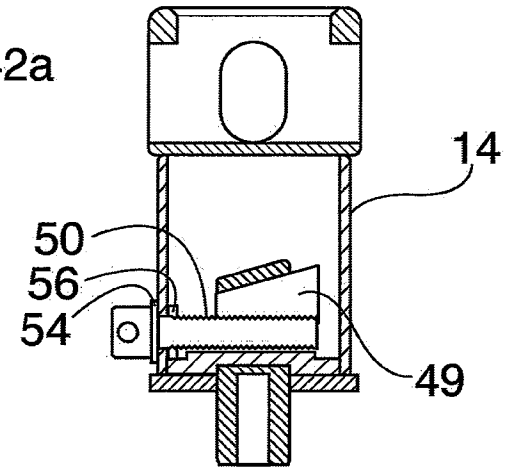
FIGS. 9*a* and 9*b* illustrate the locking tongue of the invention in its disengaged state and the mechanism for moving the same.
Figure 9A:
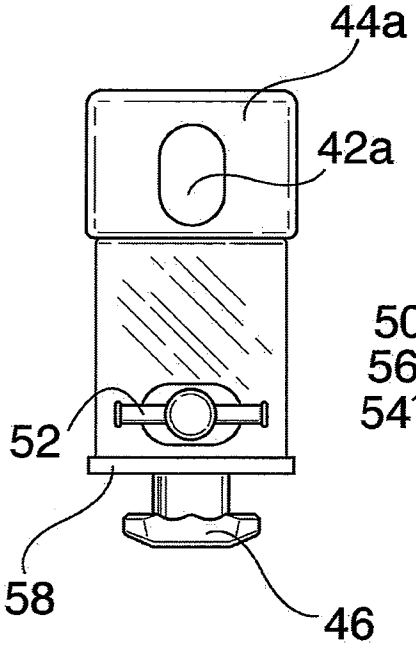

In the preferred embodiment of the invention, the tube portion 28 of the leg 14 can be constructed in two or more telescoping parts so that the length thereof can be adjusted as needed. As best shown in FIGS. 4*a*-4*c*, the lower part 32 of the leg slides into the upper part 34. Lower part 32 includes a plurality of apertures 36 while the upper part includes an aperture 38. When the selected apertures are aligned, the lower and upper leg parts 32 and 34 are locked in place utilizing the locking pin 40.

The corner casting 30 is similar to conventional castings but differs in several significant ways. First, as pointed out above, the casting is made of aluminum rather than steel which greatly reduces the weight thereof. Like conventional corner castings, corner casting 30 includes oblong openings such as shown at 42*a*, 42*b*, 42*c* and 42*d* in the vertical walls 44*a*, 44*b*, 44*c*, and 44*d* thereof. Unlike conventional castings, however, the openings 42*a*, etc. are centered in their respective vertical walls 44*a*, etc. As a result, there are no left or right handed posts or legs. All of the legs are interchangeable and can be used in any location on the pallet 12. This reduces the cost of producing the legs and also reduces the number of legs that must be maintained in inventory. It also reduces the time that it takes to install the legs as the installer does not have to take the time to select a right or left handed leg. As with conventional corner castings, each corner casting 30 also includes a conventional opening 48 at the top thereof.

Figure 3:
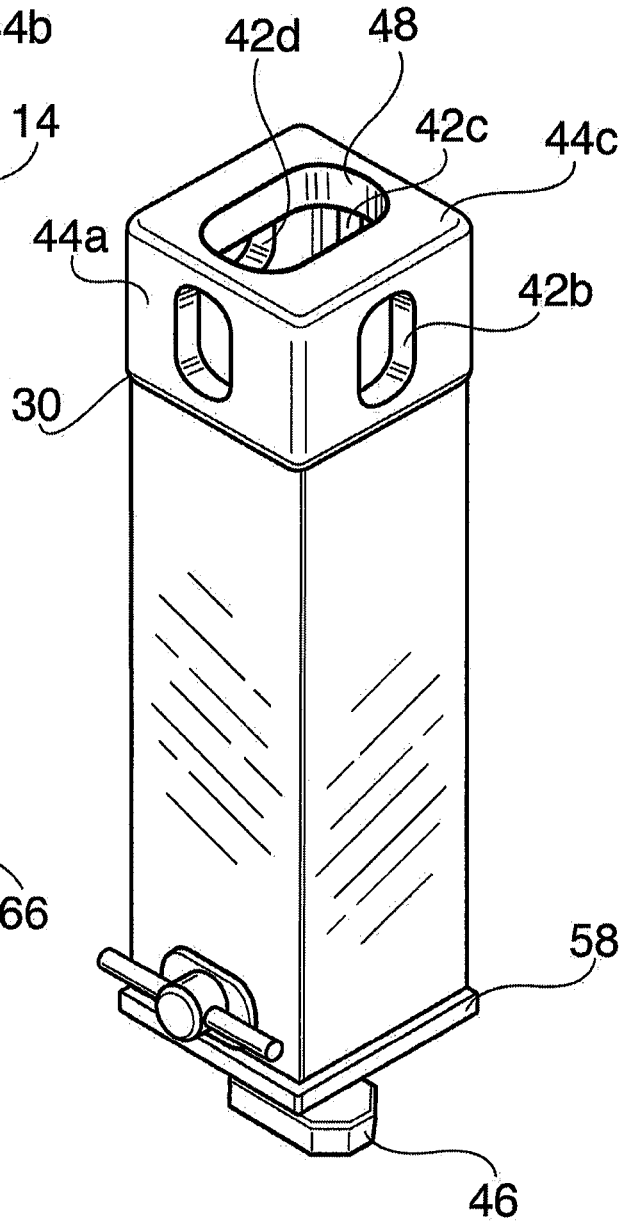
FIG. 3 is a front and top perspective view similar to FIG. 2 showing an improved leg.

Each leg, such as leg 14, also includes an anchor 46 at the bottom end thereof. As is well known in the art, the anchor 46 is used to attach the leg 14 to the top of a casting 16 or 20 in a pallet or to substantially any other casting. The anchor 46 is constructed and operates generally in a conventional manner. That is, the leg 14 is placed over the top opening in the casting 16, for example, and the entire leg 14 is then rotated 90°. The anchor 46 is then moved upwardly to grip the interior surface of the casting 16 to secure the leg 14 to the casting 16. The general manner in which this is accomplished is conventional and can be seen in FIG. 3*b* of U.S. Pat. No. 9,663,268. As shown therein, a wedge is moved laterally by turning a threaded bolt. As the wedge moves, it enters a wedge shaped opening in the stem of the anchor and cams it upwardly into its locking position. Reversing the rotation of the bolt releases the anchor. Again, this general operation is conventional and well known in the art.

The present invention differs from the conventional wedge 49 and screw arrangement 50 in structurally minor but significant ways. In accordance with the present invention, there are fewer threads on the threaded bolt 50 and they are spaced further apart from each other. And, obviously, the internal thread in the wedge 49 is complementary to the thread on the bolt 50. As a result of this arrangement, only a half rotational turn of the bolt 50, using the handle 52, is needed to move the wedge 49 up or down approximately one quarter of an inch which is sufficient to lock the anchor 46 and, thereby the leg 14 into place. Even further, lock washers 54 and 56 are located on the bolt 50 on the inside and outside of the leg 14. This prevents the bolt from any axial movement and allows for rotational movement only.

The present invention also includes a novel way of connecting the anchor 46 to the leg 14. As with conventional anchors, the anchor 46 and the wedge 49 and the other operative component parts are carried by a plate 58. In conventional systems, the plate is connected to the leg through the use of bolts passing through openings in the plate that cooperate with threaded tabs located on the inside of the leg. Because the leg 14 of the present invention is made of aluminum, conventional securing systems cannot be used. Aluminum bolts are not strong enough and steel bolts cannot be used as this may cause a galvanic reaction between the steel bolts and the aluminum leg 14.

To resolve this issue, aluminum bushings 60 are welded to the inside corners of the bottom of the leg 14. A zinc plated steel bushing 62 having a knurled outer surface 64 is swaged into each aluminum bushing, preferably before welding. The interior of the steel bushing 62 is threaded to receive a threaded steel bolt 66 passing through the plate 58 in order to hold the anchor mechanism in place.

The present invention may be embodied in other specific forms without departing from the spirit or essential attributes thereof and accordingly reference should be made to the appended claims rather than to the foregoing specification as indicating the scope of the invention.

The invention claimed is:

1. An intermodal warehousing system comprising a platform and a plurality of legs adapted to be connected to said platform, where each of said legs includes an elongated square portion, an anchor located at one end of said elongated square portion that is adapted to be secured to a corner casting of said platform and a casting located at the other end of said elongated square portion that is adapted to connect to another anchor, where said elongated square portion and said casting of each of said legs are comprised of aluminum, wherein said anchor is carried by a plate that is bolted to said square portion, where said square portion of each of said legs includes aluminum bushings welded thereto adjacent said plate and is further comprised of steel bushings within the aluminum bushings, the steel bushings having internal threads and said bolts being threaded into the steel bushings.

2. The intermodal warehousing system of claim 1 wherein said steel bushings are zinc plated.

3. The intermodal warehousing system of claim 2 wherein said steel bushings have knurled outer surfaces and are swaged into said aluminum bushings.

4. The intermodal warehousing system of claim 1 wherein said elongated square portion of said leg is comprised of two telescoping parts whereby the length of the elongated square portion is adjustable.

5. The intermodal warehousing system of claim 1 further including a handle located on the exterior of said square portion, said handle including a handle bolt extending into the interior of said leg and threaded into a wedge located with said leg for moving said wedge laterally when said handle is rotated, said anchor including an upper portion within said leg cooperating with said wedge whereby rotation of said handle moves said anchor up or down.

6. The intermodal warehousing system of claim 5 further including lock washers on said handle bolt, one of said washers being located in the interior of said leg and another of said washers being located on the exterior of said leg, said lock washers preventing lateral movement of said handle bolt.

7. The intermodal warehousing system of claim 6 wherein said handle bolt, said wedge and said anchor are so constructed and arranged so that a rotation of 180 degrees of said handle moves said anchor up or down approximately one quarter of an inch.

8. The intermodal warehousing system of claim 1 wherein said castings on said legs include four sides and an opening on each side, each of said openings being center on its respective side.

* * * * *